US006577292B1

(12) United States Patent
Miyazawa

(10) Patent No.: US 6,577,292 B1
(45) Date of Patent: Jun. 10, 2003

(54) PANEL TYPE COLOR DISPLAY DEVICE AND SYSTEM FOR PROCESSING IMAGE INFORMATION

(76) Inventor: Kuniaki Miyazawa, 8-12-30-221, Nobidome, Niza-shi, Saitama (JP)

( * ) Notice: Subject to any disclaimer, the term of this patent is extended or adjusted under 35 U.S.C. 154(b) by 0 days.

(21) Appl. No.: 09/561,284

(22) Filed: Apr. 28, 2000

Related U.S. Application Data

(63) Continuation of application No. 08/546,330, filed on Oct. 20, 1995, now Pat. No. 6,078,304.

(30) Foreign Application Priority Data

Oct. 24, 1994 (JP) ..... 6-284387

(51) Int. Cl.[7] ..... G09G 3/36
(52) U.S. Cl. ..... 345/89; 345/88; 345/690
(58) Field of Search ..... 345/88, 89, 85, 345/147, 598, 212, 690; 359/59; 340/793, 701

(56) References Cited

U.S. PATENT DOCUMENTS 5,079,544 A * 1/1992 DeMond et al. ..... 340/701
5,093,652 A 3/1992 Bull et al.
5,119,086 A * 6/1992 Nishioka et al. ..... 340/793
5,122,791 A 6/1992 Gibbons et al.
5,225,823 A * 7/1993 Kanaly ..... 340/793
5,347,294 A 9/1994 Usui et al.
5,402,143 A 3/1995 Ge et al.
5,566,010 A * 10/1996 Ishii et al. ..... 359/59
5,604,513 A * 2/1997 Takahashi et al. ..... 345/153
5,699,078 A * 12/1997 Yamazaki et al. ..... 345/147
5,751,264 A * 5/1998 Cavallerano et al. ..... 345/85
5,751,279 A * 5/1998 Okumura ..... 345/212
6,225,967 B1 * 5/2001 Hebiguchi ..... 345/88
6,323,871 B1 * 11/2001 Fujiyoshi et al. ..... 345/598

FOREIGN PATENT DOCUMENTS

EP 0709823 A2 5/1996

* cited by examiner

*Primary Examiner*—Bipin Shalwala
*Assistant Examiner*—David L Lewis
(74) *Attorney, Agent, or Firm*—Patterson, Belknap, Webb & Tyler LLP

(57) ABSTRACT

An improved panel type color display device and system for processing image information includes a combiner circuit for combining, in correspondence, line address information, data selector address information, and plotting information to vary a transmittance level by applying a pulses to each pixel, each pulse having a duration shorter than that which would cause the pixel to reach its maximum transmittance level.

12 Claims, 11 Drawing Sheets

PANEL TYPE COLOR DISPLAY DEVICE AND SYSTEM FOR PROCESSING IMAGE INFORMATION

This application is a continuation of application Ser. No. 08/546,330, filed Oct. 20, 1995, which issued as U.S. Pat. No. 6,078,304 on Jun. 20, 2000.

BACKGROUND THE INVENTION

The present invention relates to a panel type color display device and a system for processing the image information, and more particularly, the invention relates to a panel type color display device of the class wherein there are provided a display portion consisting of a plurality of pixels, of which each is driven in response to the image information to vary the light transmittance thereof, and backlight sources, of which each can be independently on-off controlled in response to the image information to emit a color light in red (R), green (G), or blue (B), and also relates to a system for processing the image information.

In recent years, apparatus for office automation use such as personal computers, and home electronic products like television sets have been made more compact, of lighter weight, and thinner shaped to a great extent. This tendency is reflected in the field of the display device, and causes the same demand for the display device. In order to meet this demand, various efforts are now being paid to develop a flat panel type display device of lighter weight and thinner shape like a liquid crystal display (LCD) as a device capable of being used in place of prevailing conventional CRT's (cathode ray tubes).

As one of technological demands for these flat panel type display devices, there is a demand for achievement of the full color display. For instance, the color liquid crystal display (LCD) of the thin film transistor system (TFT) realizes the color display by adopting the active matrix system. According to this TFT system, the dot driving is carried out on the dot by dot basis, so that the high duty dot driving can be obtained by making use of the memory effect of condensers respectively associated with dots, thereby providing the LCD that can display color images with excellent contrast. However, this system never fails to require a lot of TFT's satisfying the VGA specification, thus inevitably resulting in not only pushing up the manufacturing cost, but also lowering the manufacturing yield. Further, what is worse, this point is still remaining as an unsolved problem up to now without finding any effective solution.

On one hand, the super twisted nematic system (STN) has succeeded in realizing a low cost color LCD by means of adopting the simple matrix system. In this case, however, the speed of frame display is not so fast that color mixture is apt to take place, thus still leaving the problem to be solve as to its poor contrast. In order to solve this problem and to realize the color display with fine contrast at the high-speed frame display, there have been proposed various driving systems as countermeasures for obviating such problem, for instance the double matrix electrode driving system, the time sharing driving system, and so forth. Furthermore, there have been proposed the active addressing driving system that tries to realize the fine contrast and the high-speed frame display without reducing the resolution, by dispersing small pulses instead of large selecting pulses and performing simultaneous scanning of all the lines.

Regardless of the TFT system or the STN system, most of conventional LCD's are adopting a color filter system comprising filters of 3 primary colors R, G, and B. In case of displaying in color R, the region for color R is made light transmissible while the other regions for G and B are made not. In case of the color filter system, however, as will be easily understood, respective color regions of R, G, and B require proper pixels corresponding thereto, so that 3 times pixels of the monochromatic display have to be driven for full color display. Therefore, in order to obtain an image with high resolution, there are required the finest precision machining, the sophisticated technology for driving pixels, and the color filters having the improved light transmittance. Moreover, there has to be solved the difficult issue of color balance adjustment in the display. As mentioned above, there are embraced in the color filter system a lot of problems that have to be obviated by solving thereof.

In view of the situation of the prior art LCD as described in the above, there has been recently proposed such a panel type color LCD adopting the 3 color backlight system as disclosed in JPA No. Hei 4 (1992)-338996. In the color LCD of this type, there are provided 3 independent light sources of which each is specifically assigned to emit a color light of R, G, or B, and is turned on in order at a predetermined period. Thus, the full color display can be obtained by applying color signals to corresponding pixels in synchronization with said period of turning on the light sources.

According to the conventional color filter system, it is possible to process color signals of R, G, and B as parallel data. For instance, if it is desired to display the image of high brightness with the R-signal, regardless of behaviors of G or B signals, it is possible to overwrite the image data on the R region of pixels by making use of the memory effect due to the condensers of the LCD driving circuit. Thus, the color video can be easily obtained with high contrast.

However, according to the 3 color backlight system, the color image information is once converted into the serial data in which the image information corresponding to respective colors R, G, and B, are switched at a predetermined period, and then, the backlight sources of R, G, and B, are sequentially turned on in synchronization with the switching period of said serial data, thereby realizing the full color image display. Therefore, as shown in FIG. 11, even though it is desired to obtain the image of high brightness with the R-signal and the liquid crystal in a predetermined pixel region is driven with said R-signal to turn it on, this ON-state of the liquid crystal with R-signal is soon erased by the G-signal or B-signal in the next period, so that it is hardly possible to obtain the adequately high quantity of the transmitting light, thus the color image with high contrast being not obtainable. Especially, this operational characteristics remarkably appears in case of realizing the color display by means of the STN system, so that it has been very much desired to promptly solve this problem.

The present invention has been made in view of the various problems as described in the above, which would never fail to come out in the course of realizing the panel type color display according to the 3 color backlight system. Accordingly, an object of the present invention is to provide a novel and improved panel type color display device which is most suitably adaptable especially to the LCD of the STN system, and in which signals for driving pixels are so improved that the frame response of respective pixels is enhanced and the color image can be obtained with high contrast.

Another object of the present invention is to provide a novel and improved panel type color display device in which the image information is developed at a high speed, and the speed of transmitting information to the LCD is made much faster.

SUMMARY OF THE INVENTION

In order to solve the problems as described above, the present invention provides a novel and improved display device of 3 color backlight system in which there are provided a display portion consisting of a plurality of pixels which are driven in response to the image information to vary the light transmittance thereof, and backlight sources of which each can be independently on-off controlled and is assigned to emit a color light of R), G, or B.

According to an aspect of the invention, there is provided a novel and improved display device wherein there are provided means for converting the color image information into the serial data in which the image information corresponding to respective colors R, G, and B is sequentially switched at a predetermined time period; means for converting said serial data of colors R, G, and B in said respective time periods into the plotting data of colors R, G, and B for use in driving a plurality of pixels existing within a predetermined range; and means for repetitively driving a plurality of pixels existing in said predetermined range within said respective time periods based on said plotting data of colors R, G, and B. In this case, it is preferable that said display device further is provided with means for controlling the number of repetitively driving a plurality of pixels existing in said predetermined range within said respective time periods in correspondence with the gradation information that is obtained from said image information.

According to another aspect of the invention, there is provided a novel and improved display device wherein there are provided means for converting the color image information into the serial data in which the image information of respective colors R, G, and B is sequentially switched at a predetermined time period; a first data bus means for parallelly developing the serial data of colors R, G, and B within said respective time period into the serial data of L (integer); a memory means for storing the plotting data of L of which each consists of the pixel information of M×N (integer) by simultaneously writing the parallel data of L corresponding to each pixel to the addresses of L; means for selecting the plotting data of K (integer) from said plotting data of L; a second data bus means for reading out the selected plotting data of K from said memory means by the pixel information of M at a time in installments of N; and means for driving the pixels of M×N existing in a predetermined range K times within said time period by means of the plotting data of K as read out. In this case, the selecting means can determine the number K of repetitively selecting said plotting data in correspondence with the gradation information as obtained from said image information.

Further, according to another aspect of the present invention, there is provided a novel and improved display device wherein there are provided means for converting the color image information into the serial data in which the image information of respective colors R, G, and B is sequentially switched at a predetermined time period; a first data bus means for parallelly developing the serial data of colors R, G, and B within said respective time period in the number L (integer) of all the gradations as requested; a memory means for storing the plotting data of L (integer) consisting of the pixel information of M×N (integer), by simultaneously writing the parallel data of L corresponding to each pixel to the addresses of L; means for selecting the plotting data of K (integer) from said plotting data of L; a second data bus means for reading out the plotting data having the gradation number (K) requested to the plotting data to be read out from said memory means by the pixel information of M at a time in installments of N; and means for driving the pixels of M×N existing in a predetermined range K times within said time period by means of the plotting data of K as read out.

Still further, according to another aspect of the present invention, there is provided a system for processing the image information wherein at the time of processing the image information through a memory having at least 3 addresses of which areas are different from one another, only all the addresses in the data area to be parallelly developed are made effective while the data designated by remaining addresses are parallelly processed. In this case, the data area of which all the addresses are to be made effective, is made different depending on whether the operation is for writing the data in or reading out the same.

For instance, according to the present invention, composite signals according to the system of NTSC (National Television System Committee) are divided into color data of colors R, G, and B, and then, these color data are converted into the serial data that are sequentially switched at a predetermined time period. Now, let us explain here the operation of the present invention by taking the case of R-signals. In case of plotting an image on a screen consisting of 640×480 dots for instance, be exciting said dots with the R-signals contained in respective time periods of said serial data, the screen is divided into two parts i.e. upper and lower parts, and there are formed the plotting data of R-color for 640×240 dots each. Pixels existing in said range and consisting of one or some dots are repetitively driven within respective time periods by means of this plotting data, thereby enabling the liquid crystal to largely respond to the signals to obtain the liquid crystal image display with high brightness. The brightness of the image is adjusted by regulating the number of repetitively driving the pixels, so that if the high brightness is necessary, it may be attained by increasing said number of repetitively driving pixels, and if lower brightness is enough, it may be done by decreasing the same. In this way, it becomes possible to give difference in color gradation of the image, thus the image appearing with high contrast.

Explaining more in detail the above, said R-signals converted into the serial data in the manner as described above are parallelly developed through a first data bus corresponding to the number of all the gradations as requested (e.g. L=256). These 256 data are separately stored in respective gradation addresses of the memory, thereby 256 plotting data of R-color being formed for the screen area of 640×240 dots. In the next, after forming the plotting data in the memory like the above, the data for 640 dots are read out at a time in response to a line address, and this is repeated 240 times with regard to respective line addresses. Accordingly, it is natural that the readout speed becomes much higher comparing with the prior art sequential readout system, which reads out one R-color plotting data for one dot at a time and repeats it 640×240 times. Further, according to the present invention, the R-color plotting data as read out with such high speed are repetitively read out plural times (256 times max.) over the time of T/256 (T: total time). Accordingly, even if the total time (T) is equal, the liquid crystal responding quantity having much wider dynamic range can be obtained comparing with the prior art system, in which the pixel is driven only one time over the total time T. Accordingly, it is possible to obtain the image with higher contrast comparing with the prior art system. The difference in gradation can be expressed by selecting the number of repetitively driving pixels, for instance 256 times driving for expressing all the gradation and 128 times driving for expressing a half of gradation.

According to the system for processing the image information of the present invention, there are provided the RAM groups which are able to store the display information on the respective pixels, which are managed by the line address and the data select address, after graduating said information by the gradation address as the display data having different gradations. Accordingly, as typically shown in FIG. 10, in the time of writing operation, all the gradation addresses are made effective, and the data of 8 bits are decoded and developed in the data buses of 256, for instance. After this, the writing for 256 bits is parallelly carried out to the respective gradation addresses according to designations by the line addresses (0~239) and the data selector addresses (0~639) as well. Contrary to this, in the time of readout operation, all the data selector addresses are made effective, and the display data for each line are parallelly read out based on the appointment by the gradation addresses (0~255) and the line addresses (0~239) as well.

As has been discussed in the above, according to the system of the present invention, 3 kinds of addresses in different areas are combined in correspondence with a sort of the operation, and all the addresses in the data area to which the data are to be developed, are made effective, thereby enabling a lot of data to be simultaneously processed at a single clock timing. Therefore, there can be attained the high-speed information transmission to the liquid crystal display and the high-speed response in driving the same.

DESCRIPTION OF THE PREFERRED EMBODIMENT

Figure 1:
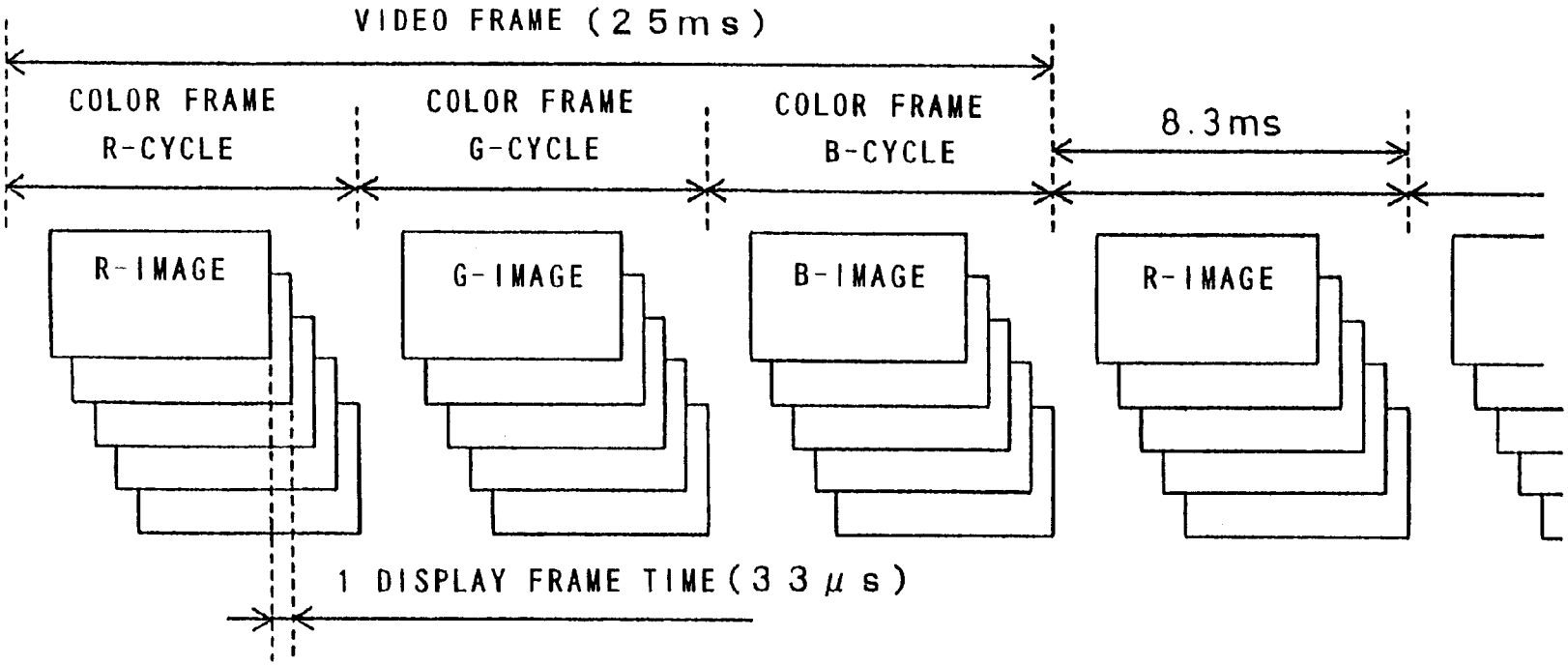
FIG. 1 is a diagrammatic representation for explaining the basic idea of a video frame, a color frame, and a display frame, which is adopted in an embodiment according to the present invention.

The preferred embodiments according to the present invention will now be described in the following in reference with accompanying drawings.

1. Definition of Frame

First of all, the description of the invention starts with explanation of the basic idea on the operation of the color display device (referred to as repetitive display system hereinafter) as constituted according to the present invention. In this repetitive display system, there are provided 3 kinds of frame frequencies having different properties from one another, which are: (1) video frame, (2) color frame, and (3) display frame. Therefore, the idea of these frames will be first explained in the following.

(1) Video Frame

This frame is the largest frame unit with the frequency (time period) of 40 to 50 Hz (20 to 25 ms). Composite signals according to the system of NTSC (National Television System Committee) are first divided into color data corresponding to respective primary color R, G, and B, and then, said color data are converted into the serial data that are switched in sequence every time period of the color frame which will be described later. The video frame is defined as the sum of a unit time period for each of said color frame (R, G, or B) in said serial data. Accordingly, respective time periods of the color frame and the display frame, which are explained later, can be determined if the video frame is set to the extent that an image resulting from composition of R-image, G-image and B-image can be visually recognized as a color picture and that the video frame can obtain an adequate quality as the color image.

(2) Color Frame

The color frame is defined as a time period, at every end of which the respective color information contained in said serial data is switched one to the other. Speaking in terms of the relation with the video frame, the color frame is the time period which consists of 3 time periods which are assigned to the image information of respective colors R, G, and B for displaying them through the video frame. For instance, if the video frame is set as 40 to 50 Hz (20 to 25 ms), the color frame becomes the time period of about 120 to 150 Hz (6.6 to 8.3 ms). Accordingly, if this color frame is made longer, the number of repetitive display by the display frame which will be described in the following is increased, so that the dynamic range as to the change in responding quantity of the liquid crystal can be widened, thereby enabling the video to be obtained with high contrast. However, it is not preferable that the color frame is too long because of causing flickers as visually recognized. Accordingly, it is actually needed that the color frame is to be set as a value enabling various parameters like flickers, contrast, and so on to be regulated. In the conventional 3 color backlight system, however, the improvement of the picture quality relied on the regulation of this color frame, so that to be natural, there was a certain limit over the contrast that could be achieved. Especially, it was hardly possible to achieve the satisfactory color video with high contrast according to the STN system. However, according to the repetitive display system of the present invention, the video with higher contrast can be realized by introducing the idea of the display frame which will be described in the following.

(3) Display Frame

According to the present invention, respective color image information, which is obtained from said serial data of colors R, G, and B, is converted into the image plotting data that drive pixels existing in a predetermined range (referred to as a plotting range hereinafter). In case of driving the image consisting of 640×480 dots partially, for instance driving it by half and half of the dots existing respectively in its upper and lower regions, the color image information is converted into the plotting data for driving the dots of 640×240. The display frame is defined as a time period during which the pixels in said plotting range are driven by one time within said color frame by using said plotting data. Accordingly, the longer the time period of this display frame is made, the more widened the plotting range can be. As described later, however, since the repetitive display system according to the present invention intends to obtain the image with high contrast by raising the change in the responding quantity of the liquid crystal, which is integrated by a plurality of plotting operations carried out on the basis of the display frame unit, if the time period of the display frame is made shorter, the number of repetitive plotting is increased that much, thereby the image with high contrast being able to come out. Further, as described later, this repetitive display system also intends to differentiate color gradation by regulating the number of repetitive plotting within the display frame, so that the number of gradation can be increased if the number of repetitive plotting is increased by shortening the time period of the display frame. Accordingly, various parameters such as plotting range, contrast, number of gradation, have to be taken account at the time of determining the time period of the display frame. For instance, in order to display with all of 256 gradations, the display frame has to be inserted in one color frame 256 times. Namely, assuming that the color frame is set as 120 Hz to 150 Hz (6.6 ms to 8.3 ms), the display frame comes to have a frequency (time period) of about 30 KHz to 38 KHz (26 $\mu$s to 33 $\mu$s).

2. Basic Operation by Means of Repetitive Display System

Figure 2:
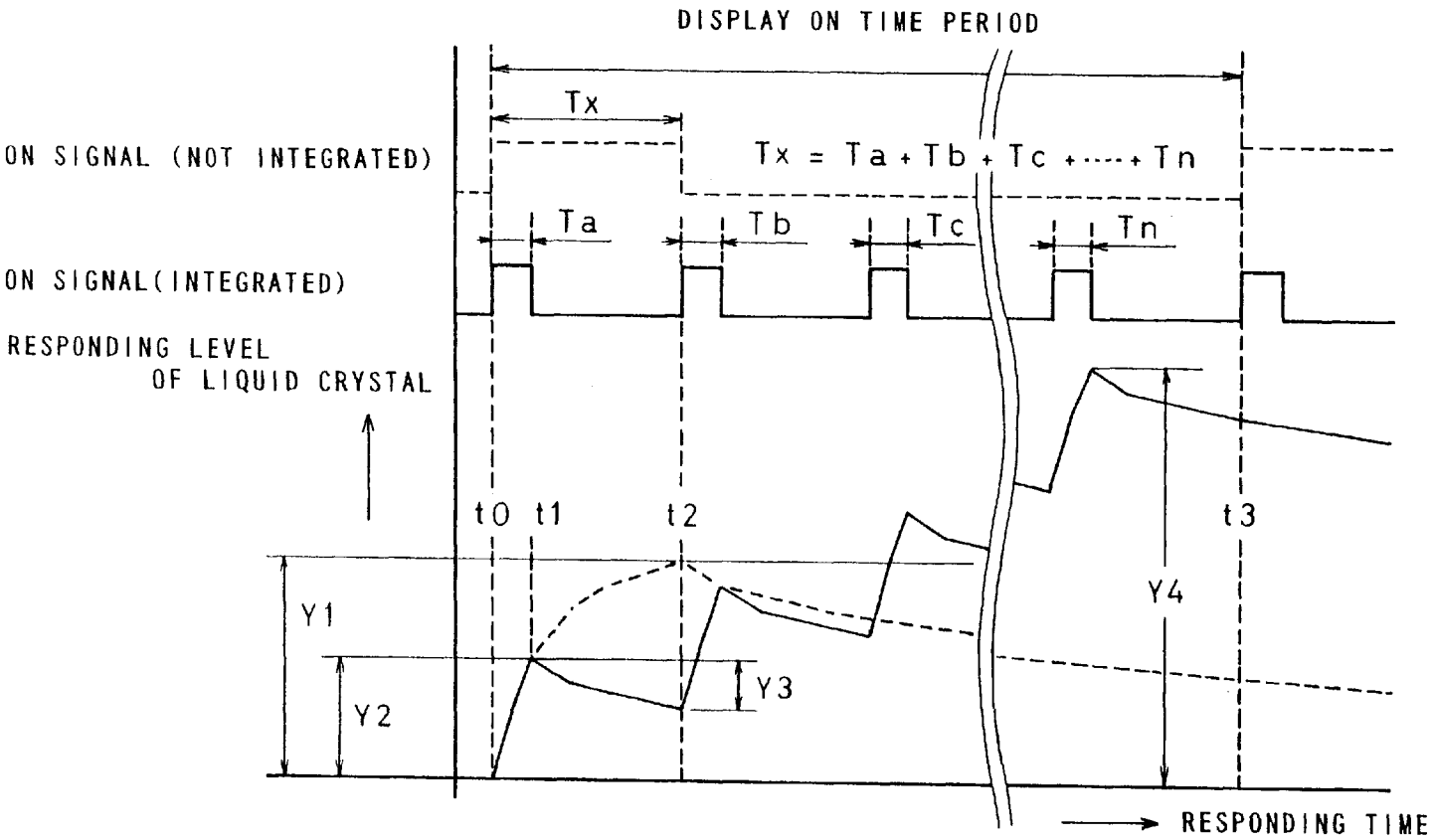
FIG. 2 is a graphical representation for explaining the response of liquid crystal in an embodiment of the liquid crystal display device adopting the repetitive display system according to the present invention.

Next, the operation of the display device adopting the repetitive display system according to the present invention will be explained in the following in reference with FIG. 2. In the course of achieving the present invention, there was noticed the fact that the liquid crystal reacts to signals for driving it in such a manner that it shows the integrating characteristics during its rising period of time while it does the differential characteristics during its falling period of time. Then, it was thought out that if the total driving time is identical, the integrating value of the responding quantity of the liquid crystal, which is obtained by dividing said total driving time into a plurality of time sectors and repetitively driving the liquid crystal every said divided time sector, should be much higher than the value which is obtained by continuously driving the liquid crystal over the total driving time. This way of thinking constitutes the essential part of the present invention.

In the conventional 3 color backlight system, after the operating signal is turned on for the period of time Tx to drive the liquid crystal for that duration (t0~t2), the operating signal is turned off to make the liquid crystal naturally attenuate, thereby obtaining the display period of tie (t0~t3), during which the display is turned on. Accordingly, the responding quantity of the liquid crystal Y1 caused by the conventional operating signal can be indicated as the following expression (1).

$$Y1 = \oint_{t2}^{t0} \tag{1}$$

In contrast with this, in the repetitive display system according to the invention, although respective driving durations (Ta, Tb, . . . ) are made shorter, the part (Y2), which has the good response at the rising time of the liquid crystal, is repetitively made use of, so that even though the total operating time is identical to that in the conventional system (Tx=Ta+Tb+ . . . +Tn), the integrated responding quantity Y4 of the liquid crystal can be made larger than said operational quantity Y1 according to the conventional system. Namely, the rising quantity of the liquid crystal Y2 in respective driving periods according to the repetitive display system is indicated by the following expression (2).

$$Y2 = \oint_{t1}^{t0} \tag{2}$$

Also, the falling quantity of the liquid crystal Y3 in respective driving periods according to the repetitive display system is indicated by the following expression (3).

$$Y3 = \oint_{t1}^{t2} \tag{3}$$

Accordingly, the integrating responding quantity of the liquid crystal Y4, which is obtainable in the total time (Tx=Ta+Tb+ . . . +Tn), can be shown by the following expression (4).

$$Y4 = \oint_{t4}^{t0} (y2 - y3) \tag{4}$$

Accordingly, it is determined from the above that Y4 is larger than Y1, so that in the repetitive display system according to the invention, it becomes possible to obtain the much larger responding quantity of the liquid crystal to the identical driving period than that which is obtained according to the conventional system. Namely, explaining in reference with FIG. 1, the time period of the display frame is set as the time Tx which is the total of respective driving time (Ta+Tb+ . . . +Tn), and the display is repeated plural times within the period of time of respective color frame, thereby obtaining in respective color frame, the responding quantity of the liquid crystal which is much higher comparing to the conventional system.

3. Expression of Gradation by Repetitive Display System

According to the present invention, the gradation of the display can be expressed by regulating the number of repetitive plotting by the display frame in each color frame.

Figure 3:
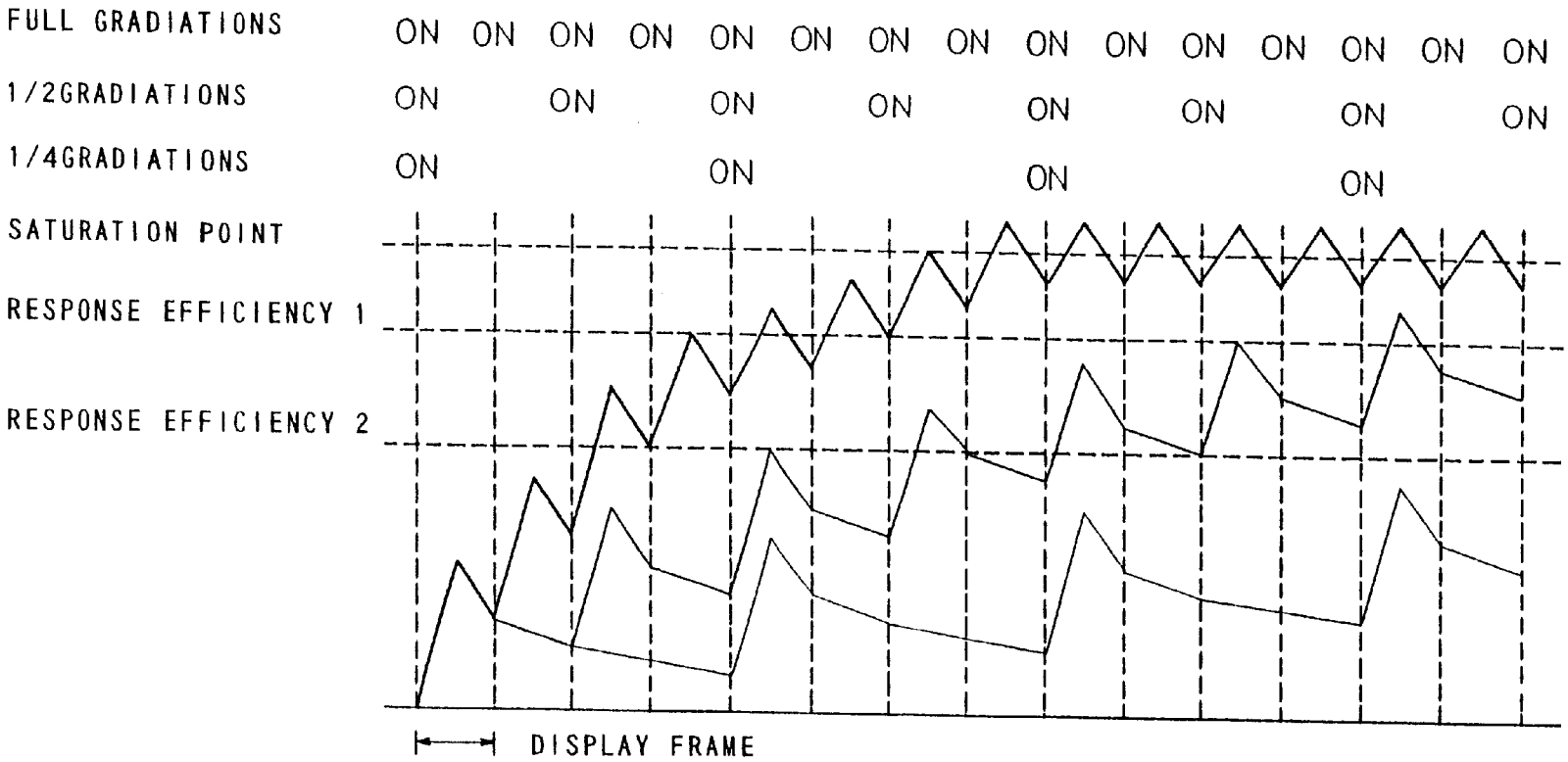
FIG. 3 is a graphical representation for explaining the gradation expression in an embodiment of the liquid crystal display device adopting the repetitive display system according to the present invention.
Figure 4:
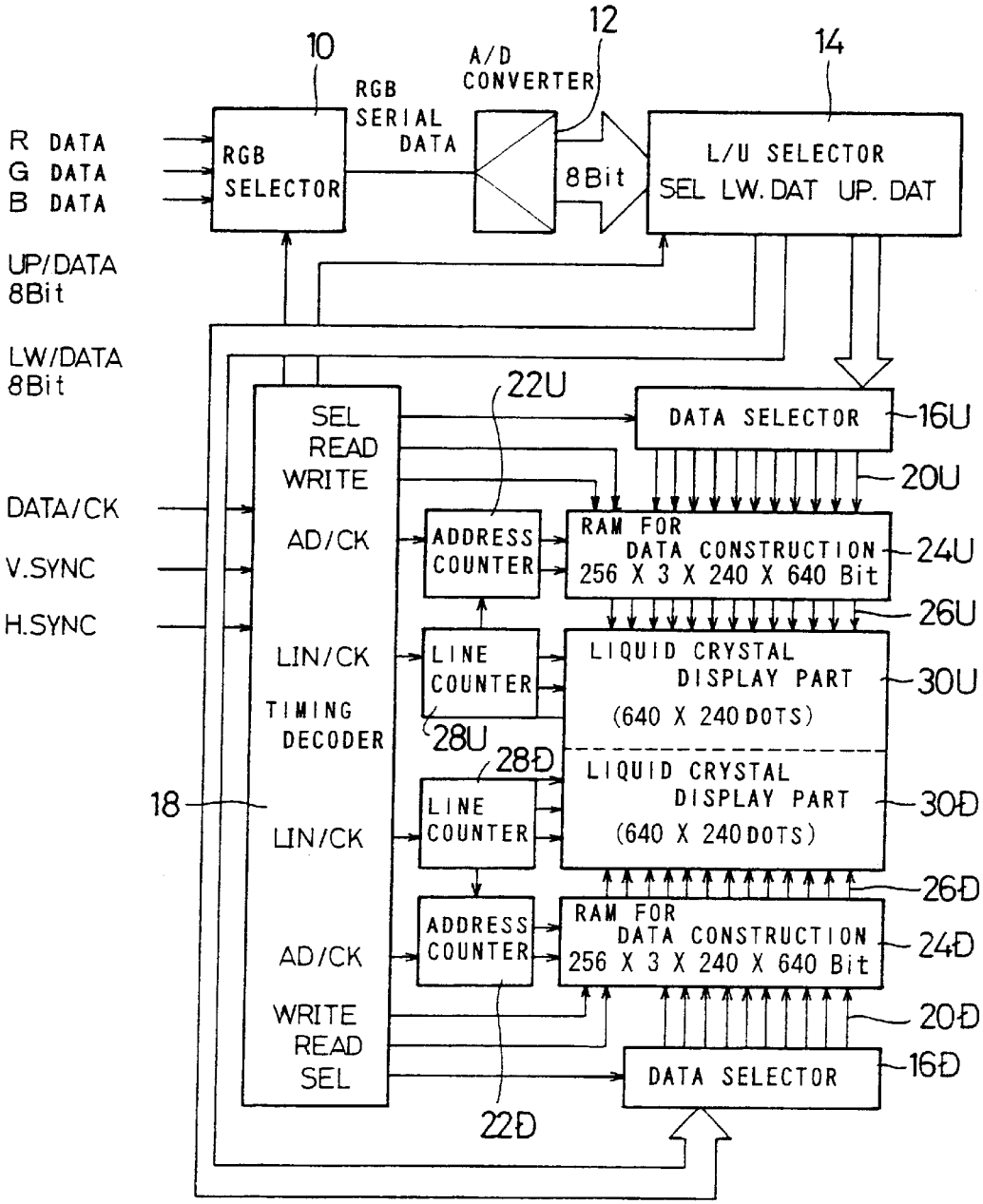
FIG. 4 is a block diagram showing the system constitution of a driving circuit in an embodiment of the liquid crystal display device adopting the repetitive display system according to the present invention.

That is, according to the present invention, as shown in FIG. 3, the integrating responding quantity of the liquid crystal can be adjusted by regulating the on-off timing of the signal for driving the liquid crystal. For instance, the display of all gradations will be possible if plotting is carried out in all the display frames. This will bring the response of the liquid crystal to its saturation point as shown in FIG. 3. Further, the display of a half gradations will be possible if plotting is carried out by a half of the above. This brings the response of the liquid crystal to the level of response efficiency 1. Still further, the display of one fourth gradations will be possible if plotting is carried out by one fourth of the above. This brings the response of the liquid crystal to the level of response efficiency 2. As described above, according to the invention, the display gradation can be expressed by regulating the number of repetitive plotting by the display frame in respective color frames.

Also, in case of controlling the display gradation, it is possible to carry out the display by repetitively reading out the identical plotting information in response to the gradation data. However, as will be described later, if the plotting information which is managed by the gradation address, prepared in advance by the number of all the gradations, the frame response of much higher speed can be obtained by sequentially reading out respective plotting information in response to the gradation information and displaying it. Also, as will be described later, if there are provided a plurality of sets of the display frames in which a predetermined plotting number is defined, it will be possible to express the gradation in combination of said sets of the display frames. For instance, in case of managing the plotting information by a memory having the gradation addresses of 256, it is possible to express the gradation by setting the gradation data of 256 steps and reading out the plotting information therefrom by an arbitrary number of times. However, it may be also possible to carry out the color display of 8 gradations by constituting the gradation data of 8 steps with 8 sets of the display frames in which 32 times plotting are made available.

4. System Constitution

FIGS. 4 through 8 are diagrammatic representations relating to an embodiment of the system constitution in respect of the color display device adopting the repetitive display system based on the present invention. It might be possible for anyone skilled in the art to design variations and modifications of this system within the technical ideas as recited in claims for patent as attached hereto, but needless to say, such varied and modified system constitutions should naturally belong to the technical scope of the present invention.

In the system constitution of this embodiment, ordinary NTSC composite signals are inputted to an RGB selector 10 every 16.6 ms and are the processed for color decomposition there. Then, the decomposed signals are converted into the RGB serial data in which respective colors R, G, and B are periodically switched every color frame. After the process of this conversion, the RGB serial data are further converted through an A/D converter 12 into the binary data of 8 bits. In the next, respective color display data for one screen, which are contained in respective color frames, are divided through an L/U selector 14 into two parts, one being the display data for the upper portion of the screen and the other being for the lower portion of the screen. These screen display data are transmitted to data selectors 16U, 16D, respectively. For instance, in case of carrying out the display of 640×480 dots. the screen display data of 640×240 dots are transmitted to each of the data selectors 16U, 16D as the screen display data for use in the upper and lower plotting regions. The vertical and horizontal synchronism of STNC signals is counted by a timing decoder 18, of which the counts are used for synchronizing various signals.

Figure 7:
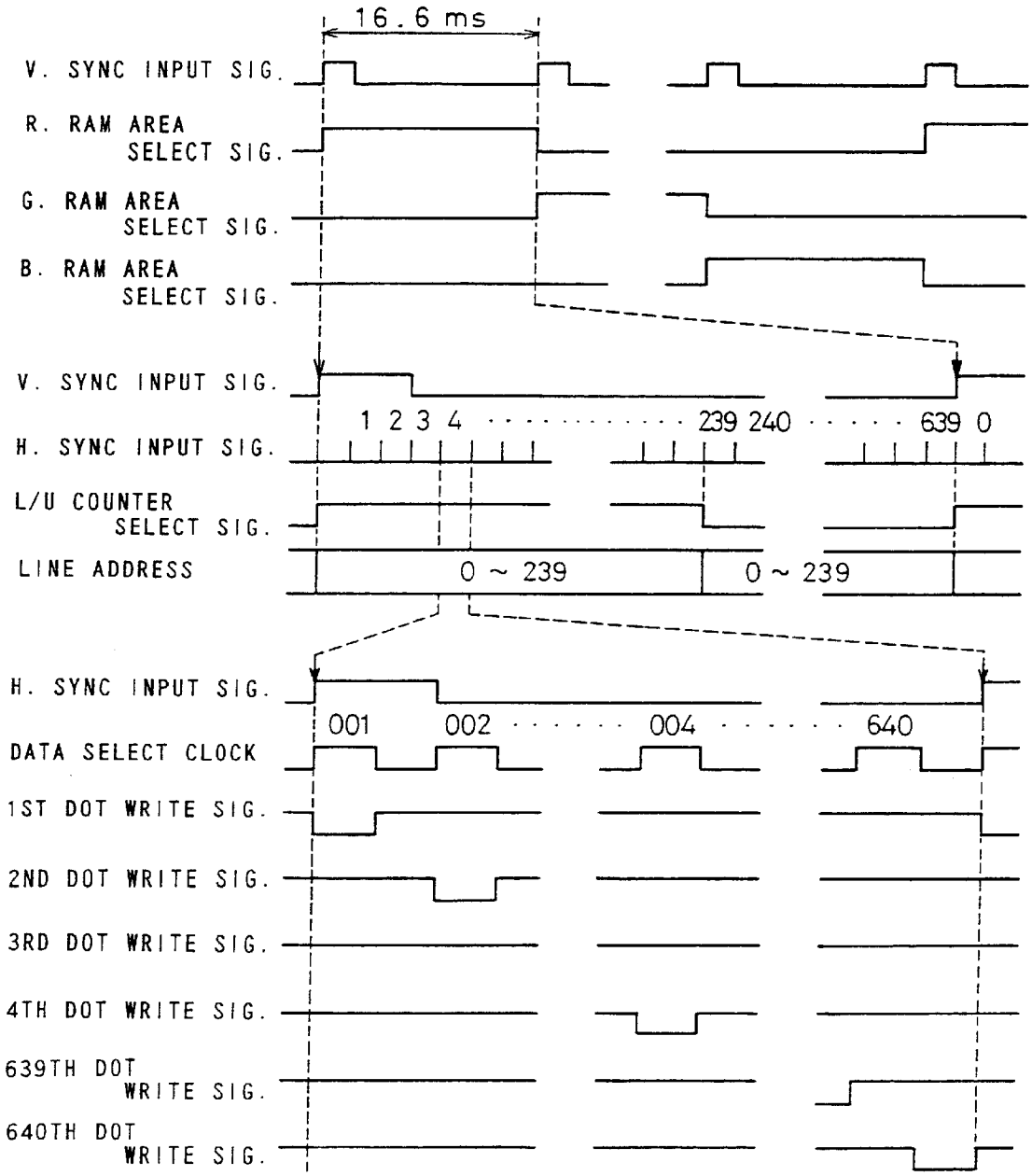
FIG. 7 is a timing chart showing the timing in the operation for writing the data in the memory, which is applicable to the system as shown in FIG. 4.

The image data transmitted to the data selectors 16U, 16D are parallelly developed through the first data buses 20U, 20D in the necessary number of gradations, for instance 256 gradations by said data selectors in response to positions on the screen, and are further developed in data constituting RAM groups 24U, 24D in response to the line address signals and the gradation address signals transmitted from address counters 22U, 22D. As a result, there are stored, as the image information for one video frame, the image data of 640×240 dots which are managed with the gradation address of 256 in respect of the color frame for each color of R, G, and B. Writing the data to the data constituting RAM groups 24U, 24D can be carried out at the operational tiling as shown in FIG. 7.

Figure 5:
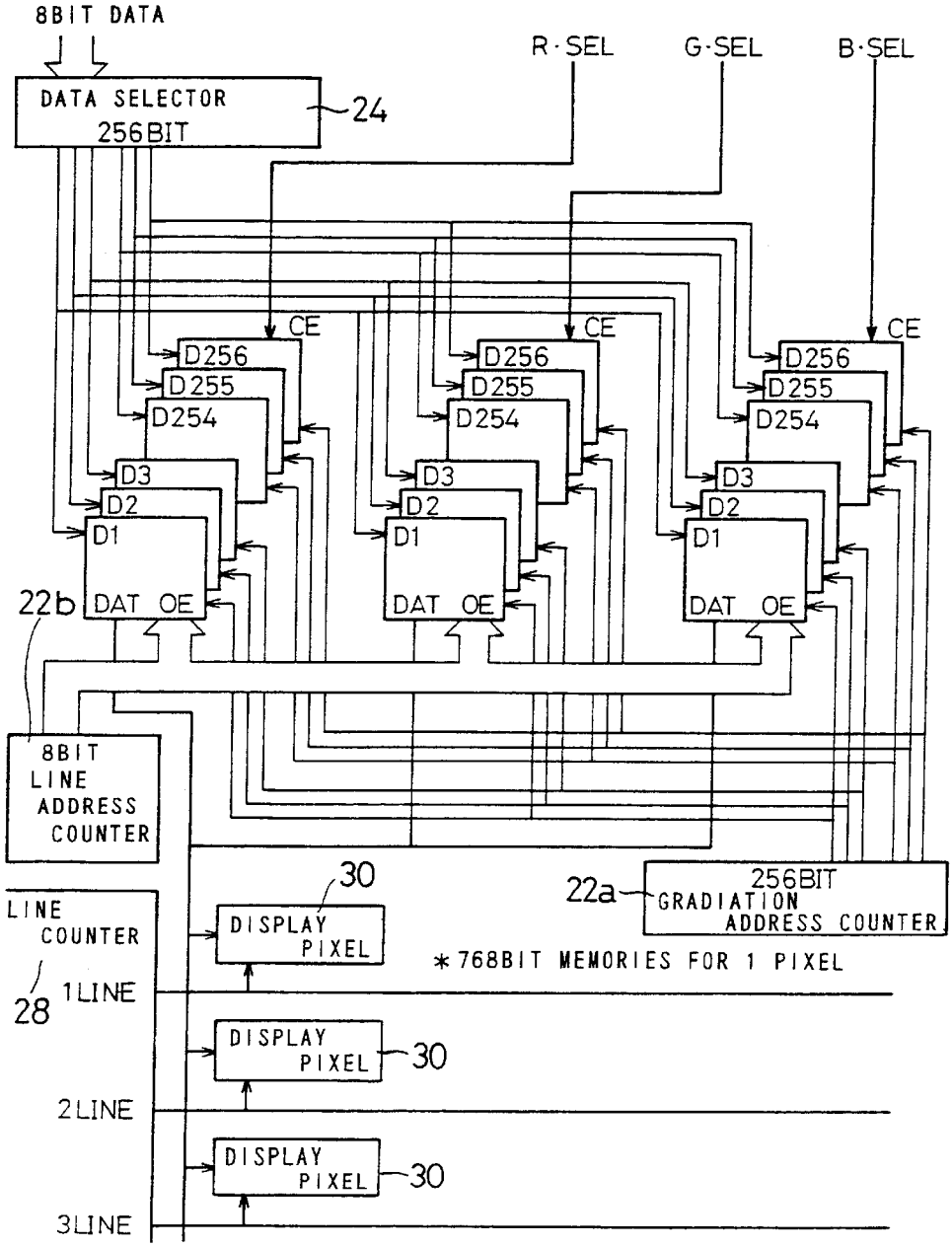
FIG. 5 is a block diagram showing the constitution of a memory system as for a single pixel, which is applicable to the system as shown in FIG. 4.
Figure 6:
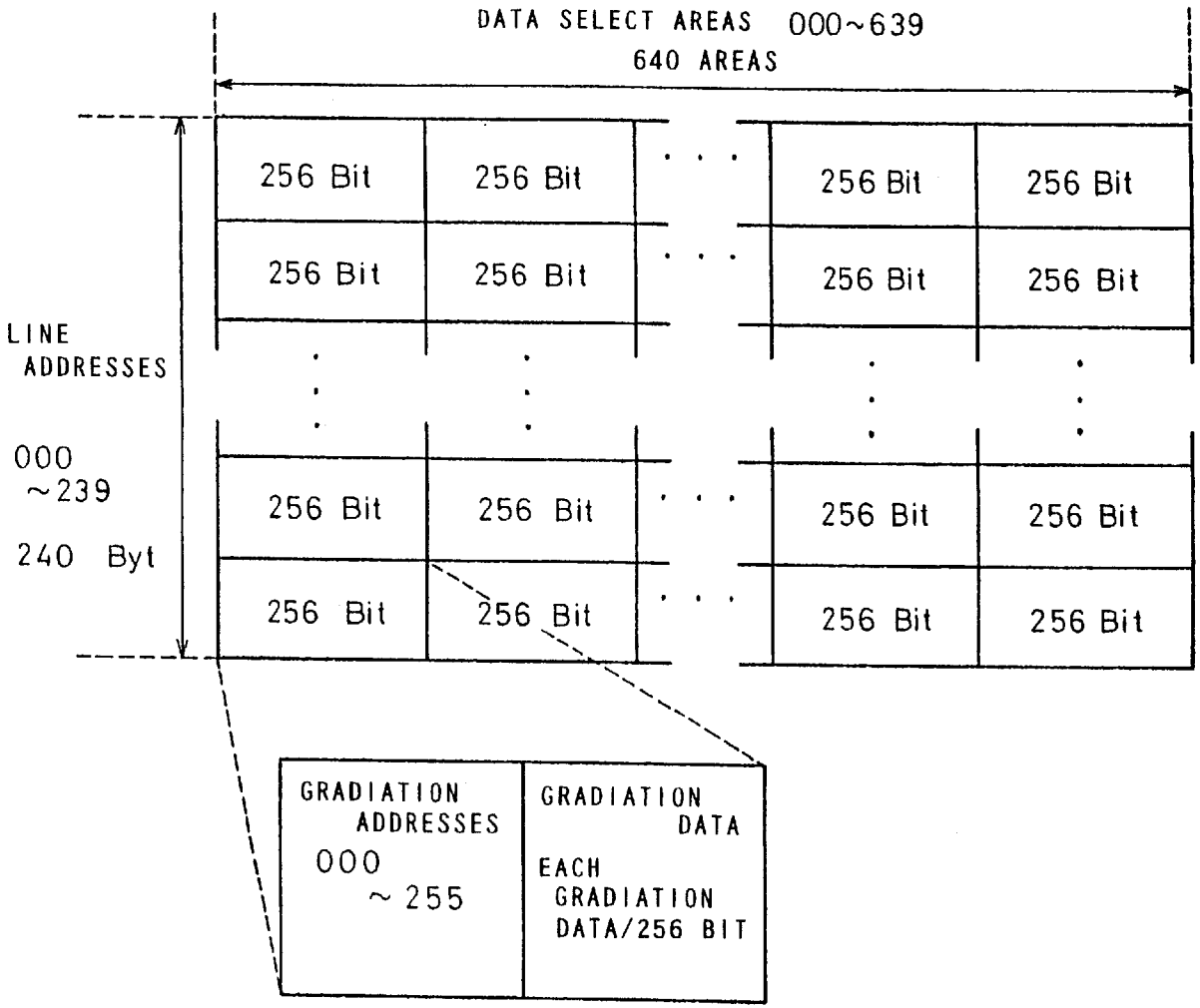
FIG. 6 is a diagrammatic representation showing the disposition and contents of the data developed in memory groups, which is applicable to the system as shown in FIG. 4.

This point will be further described in detail referring to FIGS. 5 and 6. Among these figures, FIG. 5 is a block diagram showing a memory constitution for a single pixel while FIG. 6 is a diagrammatic representation showing the disposition and contents of the data as developed in the data constituting RAM groups 24U, 24D. As shown in FIG. 5, the image data for one pixel are parallelly developed through the first data bus 20 from the data selector 24 so as to have gradations of 256 with respect to each of colors R, G, and B, and are stored at storage positions of 256, of which each is managed through a gradation address counter 22*a*. The positional information of these pixel data on one screen is managed through a line address counter 22*b*. In this way, as shown in FIG. 6, the image information with gradations corresponding to the gradation addresses of 256 is developed and stored in the data constituting RAM groups 24U, 24D with regard to respective pixel areas which are defined by the data selecting areas of 640 and the line addresses of 240. This state is diagrammatically shown in FIG. 1 where respective image data are drawn as a plurality of display frames which are lying one upon another by the number of gradations of respective color frames.

Figure 8:
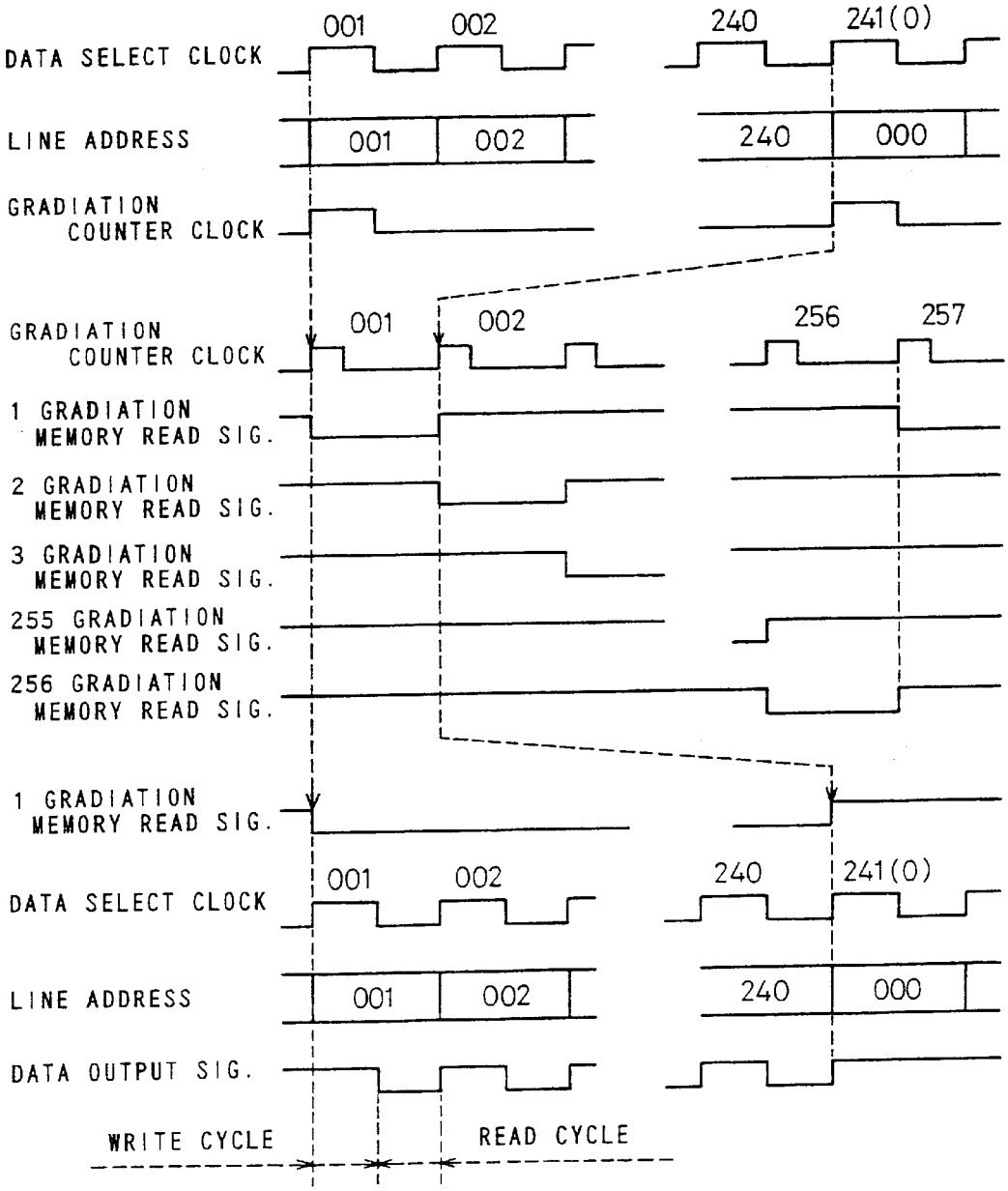
FIG. 8 is a timing chart showing the timing in the operation for reading the data out of the memory, which is applicable to the system as shown in FIG. 4.

As described above, the image data stored in the data constituting RAM groups 24U, 24D are counted by line counters 28U, 28D on the line by line basis and are read out by 240 lines each through the second data bus 26U, 26D, thereby driving respective pixels in the upper and lower liquid crystal display portions 30U, 30D having the display regions consisting of 640×480 dots in total. In this time, according to the repetitive display system according to the invention, as shown in FIG. 3, the necessary number of the image information can be read out in order by designating the gradation addresses which store the image information to be read out. By constituting the system like the above, it becomes possible to increase the responding quantity of the liquid crystal more than the prior art, to graduate the liquid crystal response in terms of color, and to transmit the image information to its display portion at a high speed. Regarding the readout timing from the data constituting RAM groups 24U, 24D, it may be done according to the operational timing as shown in FIG. 8. With regard to the more concrete display timing, the description will be made later referring to FIG. 9.

5. Display Operation Timing in Repetitive Display System

Figure 9:
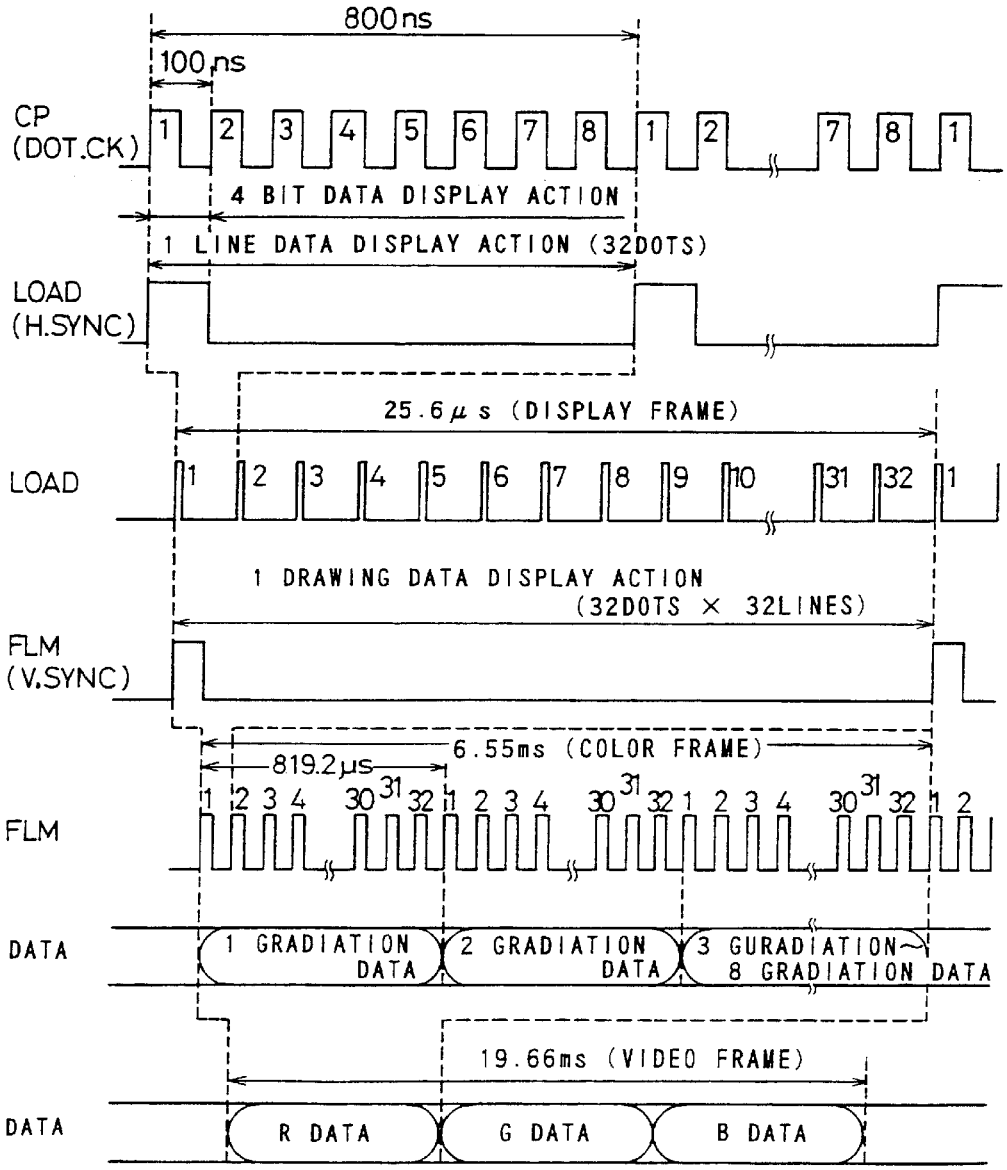
FIG. 9 is a timing chart showing the timing in the display operation in another embodiment of the liquid crystal display adopting the repetitive display system according to the present invention.

In the next, the repetitive display system as is constituted in the above according to the invention will be described taking a case of the display operation of the executable system, referring to timing charts as shown in FIG. 9. To simplify the explanation, however, the timing charts in FIG. 9 correspond to the case that the color display is to be carried out over the plotting region of 32 dots×32 dots (4 bits×8 clocks).

For instance, in case of controlling a signal of 100 ns as a dot clock signal, one pulse (100 ns) can carry out the data display of 4 bits per 1 dot, so that 800 ns are needed for displaying one line of 32 bits. In this way, if 32 lines are displayed on the line by line basis, it is possible to display the image information per screen. As already described hereinbefore, the time period necessary for this operation is defined as the display frame according to the invention. Accordingly, the display frame requires 25.6 $\mu$s in the present case. Further, according to the invention, the color image display can be obtained with high contrast by repeating said display frame 256 times to constitute the color frame of 6.55 ms and repetitively displaying the plotted image. Still further, in order to express the gradations, the present case adopts the constitution where the display frame for 256 times is further divided every display frame for 819.2 μs and 32 sets, thereby setting the gradation data of 8 steps, and the number of plotting is managed by the gradation address. In the present case, the gradation data is constituted by using the continuous display frames for 32 times as one set, but needless to say, it is also possible to constitute the gradation data by making, use of the display frame of 1+8nth. 2+8nth, . . . 8+8nth (n=0,1, . . . 32) as one set. As described in the above, the color frame for each color R, G, or B is constituted by the display frame for 256 times, and the video frame of 19.66 ms is constituted by displaying the color frame of each color R, G, or B one time each. As a result of this, the color video having desired gradation can be displayed with high contrast and high-speed response.

So far, the embodiment of the present invention has been described taking the liquid crystal device as an example, but the invention is not limited to this embodiment. The present invention can be applicable of all the sorts of panel type display devices adopting the backlight system, for instance Magnetic Fluid Display which has been applied for patents by the applicant of this application and disclosed in JPA Nos. Hei 5 (1993)-191787, hei 5 (1993)-270063, and Hei 6 (1994)-156816. Further, this invention can be most preferably applied to the liquid crystal display of the STN system. However, the invention is not limited to this, but is applicable to the liquid crystal display adopting other various systems, for instance TFT systems, ECB system, ferroelectric system, field-sequential system, and so forth.

Since the invention is constituted as has been explained in the above, the invention can take excellent effects as follows.

(1) High-speed Response of Liquid Crystal Obtained by Repetitive Display System

According to the present invention, the image data for one screen are repetitively overwritten within the respective color frames, and the liquid crystal is intermittently driven in plural installments. Thus, the high-speed response and the large responding quantity of the liquid crystal can be surely obtained comparing with the case of continuously driving the liquid crystal. As a result, the video with high contrast can be realized within respective short color frames.

(2) Gradation Control of Liquid Crystal Display by Repetitive Display System

According to the present invention, the difference in gradation can be expressed within respective short color frames by regulating the number of repetitive overwrite of the plotting data for one screen within respective color frames. Namely, in case the higher brightness is desired, it may be obtained by increasing the number of repetitive display while in case the lower brightness is enough, it may be attained by decreasing the same. In this way, the gradation can be differentiated.

(3) High-speed Information Transmission to LCD

Figure 10:
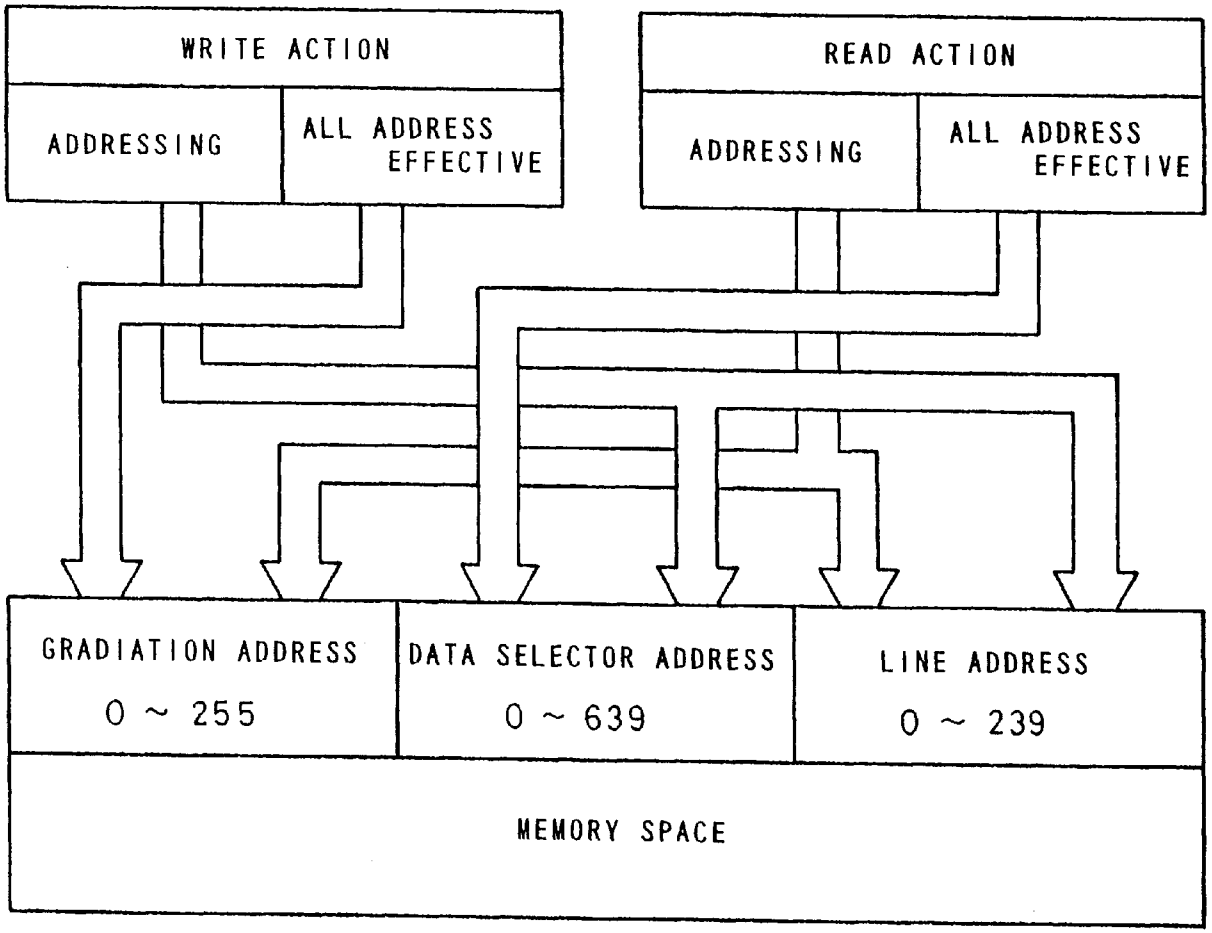
FIG. 10 is a schematic diagram showing a system of processing the image information.
Figure 11:
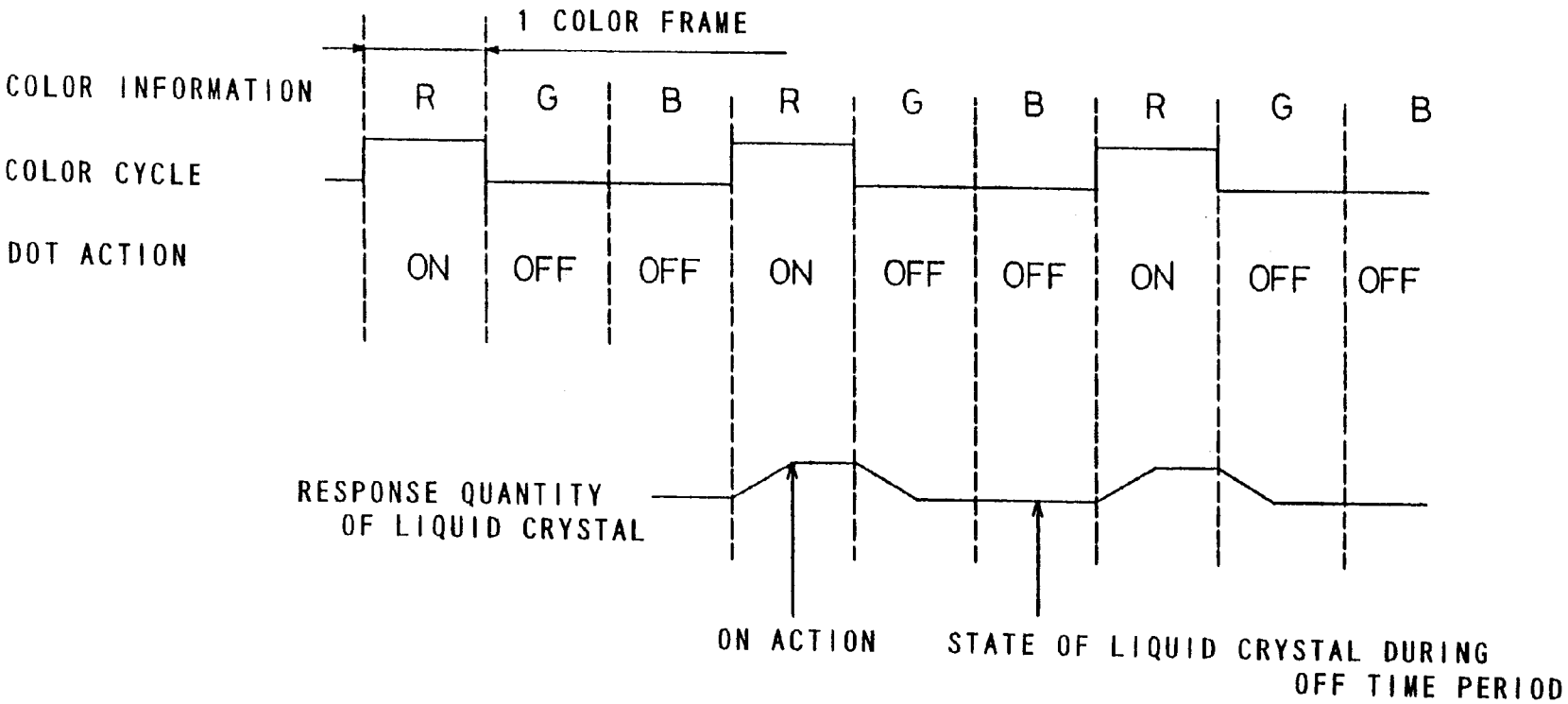
FIG. 11 is a timing chart showing the timing in the operation for switching colors according to the prior art 3 color backlight system.

In an embodiment constituted according to the present invention, there are provided RAM groups which are able to store the display information on respective pixels which are managed by the line address and the data select address, said display information being graduated by the gradation address as the display data having differentiated gradations. Accordingly, as typically shown in FIG. 10, at the time of data writing operation, all the gradation addresses are made effective, and the data of 8 bits are decoded and developed through the data buses of 256 , for instance. After this, the writing for 256 bits is parallelly carried out to the respective gradation addresses according to designations by the line addresses (0~239) and the data selector addresses (0~639) as well. Contrary to this, at the time of readout operation, all the data selector addresses are made effective, and the display data for each line are parallelly read out based on the appointment by the gradation addresses (0~255) and the line addresses (0~239) as well.

As has been discussed in the above, according to the present invention, 3 kinds of addresses in different areas are combined in correspondence with the operation as requested, and all the addresses in the data area to which the data are to be developed, are made effective, thereby enabling a lot of data to be simultaneously processed at a clock timing. Therefore, there can be realized the high-speed information transmission to the liquid crystal display and the high-speed response in driving the same.

What is claimed is:

1. A display system comprising:

a) a display having a plurality of pixels capable of variable transmittance and arranged in a predetermined pattern;

b) a first memory for storing pixel line address information;

c) a second memory for storing pixel data selector address information; and d) a third memory having a plurality of pixel gradation addresses, each of said gradation addresses managing pixel plotting information and affecting pixel transmission characteristic; and e) a combiner for combining in correspondence the line address information, the data selector address information, and the plotting information to vary a transmittance level by applying a plurality of pulses to each pixel, each pulse having duration shorter than a duration of time in which a pixel can reach its maximum transmittance level.

2. The display system of claim 1, wherein the display is a color display.

3. The display system of claim 2, further comprising a backlight source.

4. The display system of claim 3, wherein the backlight source emits a red, green, or blue light.

5. The display system of claim 4, wherein the combiner sequentially varies a display transmittance level for each emitted color.

6. The display system of claim 1, wherein during a write cycle the gradation information is written in parallel to the respective gradation addresses according to the designations by the line addresses and the pixel data selector addresses.

7. The display system of claim 6, wherein during a read cycle the pixel data selector information is read out in parallel according to the designations by the gradation addresses and the line addresses.

8. The display of claim 7, wherein different portions of the display are controlled in parallel.

9. A method for driving a variable transmittance display having a plurality of pixels arranged in a predetermined pattern, a first memory for storing pixel line address information, a second memory for storing pixel data selector address information, and a third memory having a plurality of pixel gradation addresses, each of said gradation addresses managing pixel plotting information and affecting pixel transmission, said method comprising the steps of:

receiving a display information;

developing a gradation information from said display information;

writing in parallel said gradation information into gradation addresses according to the designations by the line addresses and the pixel data selector addresses; and reading in parallel the pixel data selector information according to the designations by the gradation addresses and the line addresses, such that the pixel transmittance levels are varied by applying a plurality of pulses, each pulse having duration shorter than a duration of time in which a pixel can reach its maximum transmittance level.

10. The method of claim 9, wherein the step of receiving a display information further comprises the steps of:

receiving color display information; and converting the color display information into serial data.

11. The method of claim 10, wherein color display information includes red, green, and blue color information, said method further comprising the step of:

varying the number of pulses used to drive the pixels in response to gradation information for each color.

12. The method of claim 11, further comprising the step of:

controlling different portions of the display in parallel.

* * * * *